US005193650A

United States Patent [19]

Kent, Jr.

[11] Patent Number: 5,193,650

[45] Date of Patent: Mar. 16, 1993

[54] PORTABLE STAIR LIFT

[76] Inventor: George W. Kent, Jr., 3522 Hampton Hwy., Yorktown, Va. 23693

[21] Appl. No.: 879,243

[22] Filed: May 6, 1992

[51] Int. Cl.[5] ..... B66B 9/08

[52] U.S. Cl. ..... 187/12; 198/322; 198/326; 198/835

[58] Field of Search ..... 187/12; 198/321, 322, 198/326, 835; 414/921

[56] References Cited

U.S. PATENT DOCUMENTS

| | | | |
|---|---|---|---|
| 966,394 | 8/1910 | Gavryloff | 187/12 |
| 1,768,650 | 7/1930 | Wood | 187/12 |
| 1,838,204 | 12/1931 | Wood | 187/12 |
| 1,927,194 | 9/1933 | Wood | 187/12 |
| 1,933,131 | 10/1933 | Wood | 187/12 |
| 2,563,260 | 8/1951 | Miller | 187/12 |
| 3,422,947 | 1/1969 | Kraft et al. | 198/321 |
| 3,500,963 | 3/1970 | Beutler | 187/12 |
| 4,043,427 | 8/1977 | Ackerman | 187/12 |
| 4,564,086 | 6/1986 | Kingston | 187/12 |
| 5,125,481 | 6/1992 | Shibata | 187/12 |

*Primary Examiner*—Joseph E. Valenza

*Assistant Examiner*—Dean A. Reichard

*Attorney, Agent, or Firm*—Wallace J. Nelson

[57] ABSTRACT

A portable stair lift system, for assistance in traversing short or medium length stairways, employs a pair of spaced elongated solid metal plates extending the stairway length and supported by a pair of vertically extending end brackets attached to a block of wood at each end thereof. An axle extends through each pair of end brackets and each axle supports a roller transversely disposed at the metal plate ends. At least one of these rollers is provided with a sprocket wheel secured to the axle between split roller segments. A reversible drive gear motor, drive chain connected to the sprocket wheel, drives the roller. A heavy duty conveyor belt is positioned about the pair of rollers. A passenger support system (either a chair seat or step segments) is secured to and movable with the conveyor belt. Manual switch means for controlling motor operation and direction are provided and actuatable by the passenger at any point along the stairway. Automatic cut-off switches stop the stair lift at either end of the inclined stairway. In a modified embodiment, (FIG. 9) dual drive chains are provided for use with long stairways.

12 Claims, 4 Drawing Sheets 46
47
50
54
44
56
12
48
51
53
53
58

FLOOR
71
75
76
70
72
10
12
66
17
22
11
14
44
44
67
45
46
49
B
47
48
18
19
21
FLOOR 26
22
22
26
IIa
IIa

PORTABLE STAIR LIFT

FIELD OF THE INVENTION

This invention relates to transport systems in general and relates specifically to a portable stair lift for transporting an individual up or down an inclined stairway.

BACKGROUND OF THE INVENTION

Numerous systems, ranging from complex escalators to rudimentary chair lift systems, have been devised for transporting individuals up or down inclined stairways. Most of these systems are complicated, expensive and require special skills for safe use by individuals. There is a definite need in the art for a simple, inexpensive, and portable stair lift that can be operated by disabled individuals in a safe and reliable manner.

It is therefore an object of the present invention to provide a portable stair lift system that is safe in operation and can be self-operated by most disabled individuals.

Another object of the present invention is a reliable stair lift that may be installed on an existing inclined stairway without altering the construction of the stairway.

A further object of the present invention is a portable stair lift that may be installed on an existing inclined stairway and occupies only a portion of the stairway width to thereby permit continued normal use of the stairway while the stair lift is installed thereon.

An additional object of the present invention is a portable stair lift that provides a rotatably adjustable seat thereon for passenger convenience and safety.

Yet another object of the present invention is to provide a portable, inexpensive, stair lift for assisting disabled or elderly individuals in traversing an inclined stairway.

SUMMARY OF THE INVENTION

According to the present invention the foregoing and additional objects are attained by providing a lift system having a pair of elongated solid metal plates of substantially the same length as the stairs over which a passenger is to be transported. Wooden blocks, disposed at each end of the pair of metal plates, are each provided with a pair of vertically extending end brackets serving as supports for the pair of spaced elongated metal plates. Aligned apertures through the respective pairs of vertically extending brackets contain suitable bearings for receiving a transverse axle therethrough. Each axle supports a roller transversely disposed between the pair of spaced elongated metal plates. At least one of these roller is provided with split roller segments having a sprocket wheel secured to the axle therebetween. A drive motor secured between the pair of spaced elongated metal plates is drive chain connected to the sprocket wheel(s) and serves as the drive force for the roller. A heavy duty conveyor belt is positioned about the pair of rollers and extends the length of the spaced elongated metal plates and is rotatably driven by the rollers. A passenger support system is secured to and movable with the conveyor belt.

In the preferred embodiment the passenger support system includes a rotatable chair releasably attached to a metal plate segment secured to the conveyor belt. Manual switches are provided adjacent the ends of the spaced elongated metal plates and actuated by the chair occupant to control the conveyor belt movement up or down along the stairway. These manual switches are connected by a small diameter rod that is disposed in reach of, and may be grasped by, a passenger to actuate the switches and stop or start the conveyor belt at any point along the length of the stairway. An additional switch contact is provided on the metal plate segment supporting the chair to automatically stop the electric motor driving the conveyor when the chair thereon reaches the top or bottom of the stairway. The manually actuated switches override this automatic cut-off when moved to the reverse position.

In another embodiment of the invention the passenger support system includes multiple simulated stair steps secured to the conveyor belt at spaced intervals therealong. In each embodiment a suitable handrail may be provided on the wall adjacent to the stair lift.

BRIEF DESCRIPTION OF THE DRAWINGS

A more complete appreciation of the invention and many of the attendant advantages thereof will become more readily apparent as the same becomes better understood when considered in connection with the accompanying drawings wherein.

DETAILED DESCRIPTION

Figures 1, 1B, 2, 2A:
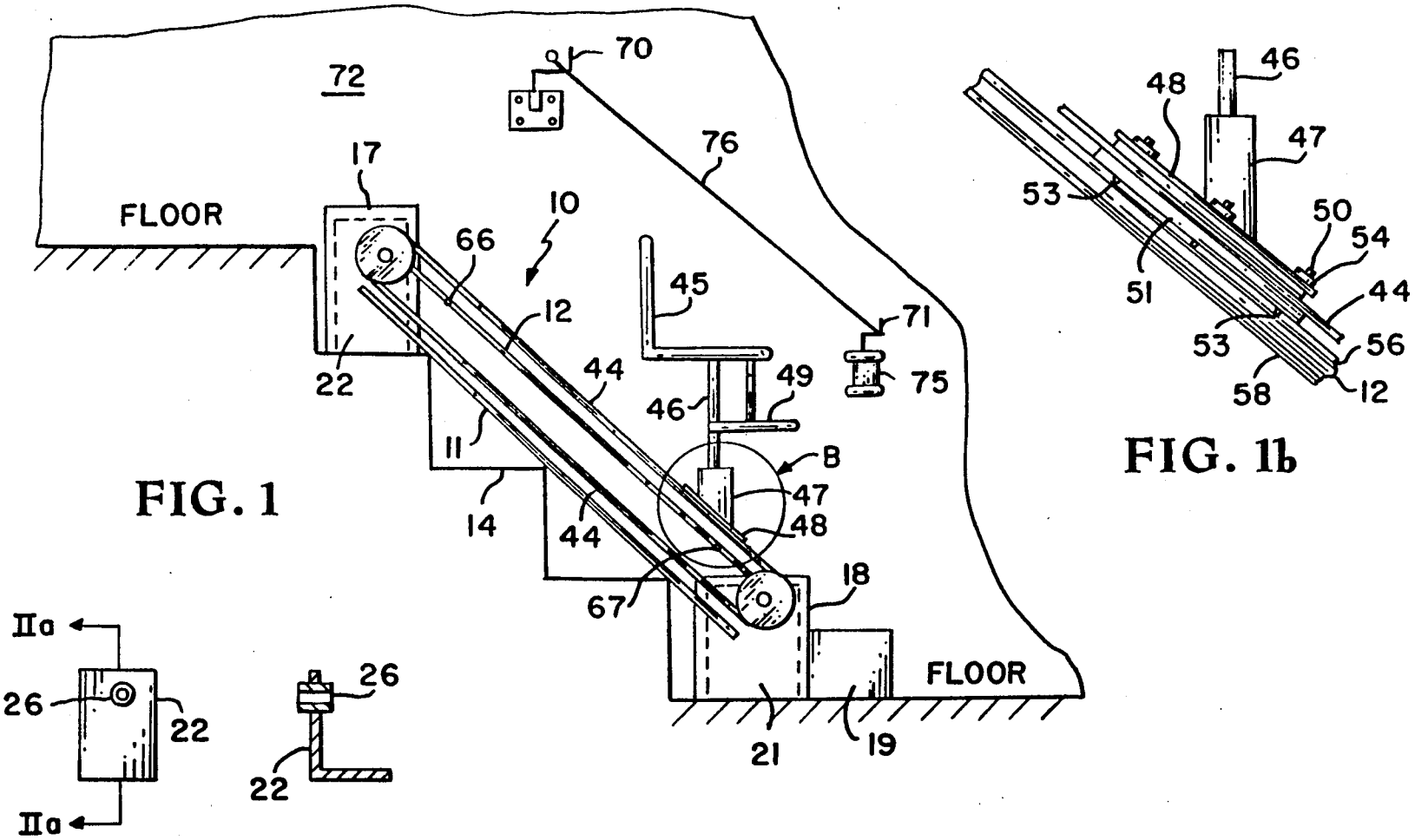
FIG. 1 is a view of the portable stair lift of the preferred embodiment of the present invention installed on an inclined stairway, with parts omitted and parts schematically shown.
FIG. 1*b* is an enlarged view of circled area B of FIG. 1.
FIG. 2 is a plan view of one of the brackets (shown in phantom in FIG. 1) employed to secure the portable stair lift of the present invention to a wooden block support.
FIG. 2*a* is a view of the bracket shown in FIG. 2 and taken along line IIa—IIa thereof.
Figure 1A:
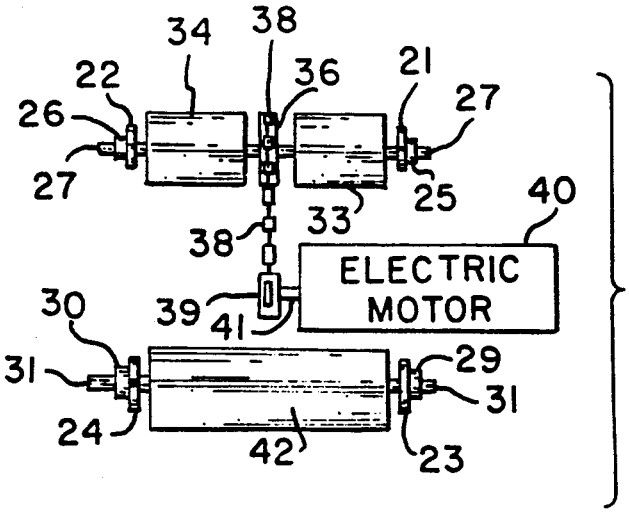
FIG. 1*a* is a part schematic view of a drive mechanism for the portable stair lift shown in FIG. 1.

Referring now to the drawings and more particularly to FIGS. 1, 1*a* and 1*b*, the preferred embodiment of the portable stair lift of the present invention is shown and designated generally by reference numeral 10. Stair lift 10 includes a pair of spaced elongated metal plates 11,12 extending the length of an inclined stairway 14 and provided with support wooden blocks 17,18 at the respective ends thereof. An unattached, removable, wooden half-step 19 is positioned adjacent wooden block 18 to facilitate passenger access to stair lift 10. A pair of L-shaped brackets 21,22 and 23,24 are conventionally attached to respective blocks 17 and 18 and respective end portions of elongated metal plates 11,12.

One of these brackets, bracket 22, is shown more clearly in FIGS. 2 and 2*a*. Aligned openings in brackets 21,22 house annular bearings 25,26 with axle 27 being rotatably disposed therein. Similar aligned openings in brackets 23,24 house annular bearings 29,30 with axle 31 being rotatably disposed therein.

As shown more clearly in FIG. 1*a*, a pair of spaced roller segments 33,34 are attached to and rotatable with axle 27. A sprocket wheel 36 is disposed between roller segments 33,34 and is also attached to and rotatable with axle 27. A sprocket chain drive 38 is connected about sprocket wheel 36 and to a drive wheel 39 driven by electric motor 40, as will be further explained hereinafter.

A single roller 42 is attached to and rotatable with axle 31. A conveyor belt 44 is disposed about roller 42 and spaced roller segments 33,34. Roller segments 33,34 constitute the drive roller while roller 42 serves as an idler roller support for conveyor belt 44, as will be further explained hereinafter.

A passenger seat or chair 45 (FIG. 1) is provided with a depending support rod 46 rotatably and slidably supported in a tube 47. Tube 47 is disposed at a substantially forty-five degree angle and attached to a plate segment 48 that is connected to and movable with conveyor belt 44. An optional passenger foot rest 49 is rotatably secured to depending support rod 46 and fixedly attached (via suitable screws or bolts) to, and rotatable with, passenger seat 45.

Figure 3:
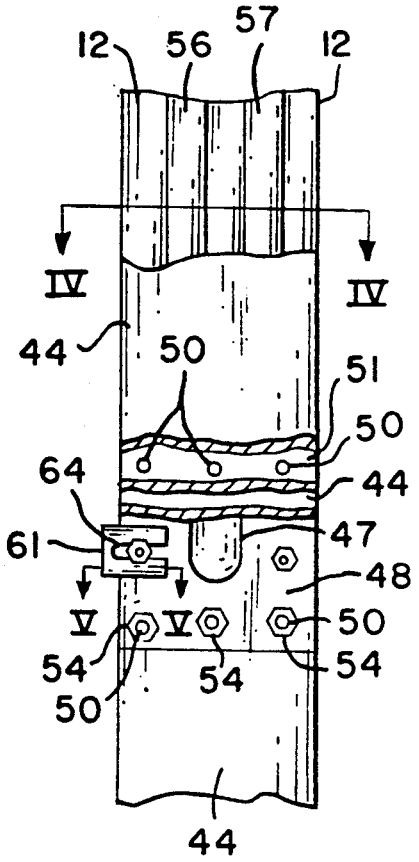
FIG. 3 is a top view of a portion of the portable stair lift shown in FIG. 1 with parts omitted and parts broken away.

As shown more particularly in FIG. 1*b* and FIG. 3, plate segment 48 is disposed on the top surface of conveyor belt 44 and bolted therethrough via bolts 50 to a similar plate segment 51. Bolts 50 are provided with heads 53 disposed against plate segment 51 and taps 54 threadingly secured thereto against plate segment 48.

Figure 4:
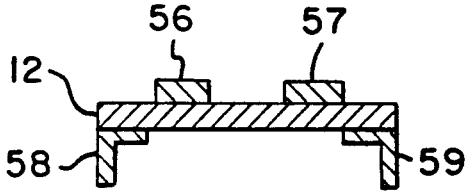
FIG. 4 is a sectional view taken along line IV—IV of FIG. 3.

The side of plate segment 51 having bolt heads 53 disposed thereagainst is disposed in sliding contact with a pair of spaced shims 56,57 welded or otherwise conventionally attached to the top surface of elongated metal plate 12. Shims 56,57 extend the length of metal plate 12 and the spacing therebetween and on the sides thereof, as shown more clearly in FIG. 4 provide channels that receive and permit relative movement of bolt heads 53 therein without frictional contact with metal plate 12 during conveyor belt movement of chair 45. Linear sections of angle iron, designated by reference numerals 58,59 are welded along the entire length of elongated metal plate 12 for adding strength and buckle resistance thereto.

A U-shaped frame 61 supporting a rotary switch contact 62 (FIG. 5) is adjustably connected to plate segment 48 via groove 64 provided in the top portion thereof and disposed about one of the bolts 50 and secured by the bolt tap 54.

Figure 5:
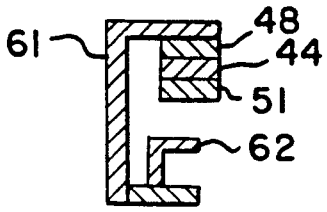
FIG. 5 is a sectional view taken along line V—V of FIG. 3.
Figure 6:
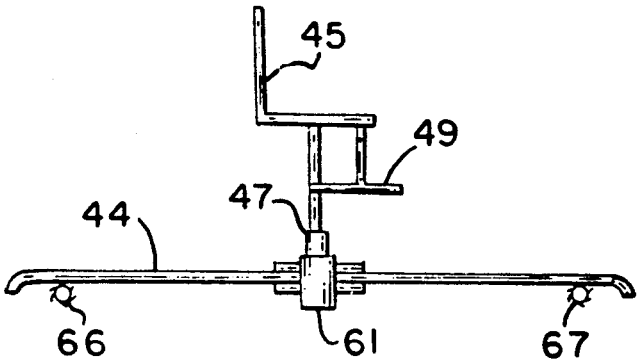
FIG. 6 is a schematic representation of the rotary on/off switches employed at each end of the portable stair lift of the present invention.

As shown more particularly in FIGS. 5 and 6, rotary switch contact 62 is adapted to engage one of rotary cut-off switches 66,67 disposed respectively, adjacent the top and bottom ends of stair lift 10 at the points where it is desired to stop movement of passenger chair 45. Rotary cut-off switches 66,67 are in electrical connection with electric motor 40. When either switch 66 or 67 is actuated, motor 40 is automatically stopped and converted to the reverse mode. Once motor 40 is stopped by either of switches 66,67 it can only be started again by manual actuation of one of the manual crank switch actuators 70,71 disposed on stairway wall 72 at the respective top and bottom thereof. (FIG. 1).

Switch actuators 70,71 are crank-shaped having a horizontal center section with right angle segments extending in opposite directions from the ends thereof. Switch actuator 70 is rotatably secured to a bracket 73 conventionally and removably attached to the wall adjacent the top of stair way 14. Manual rotation of either switch actuator 70,71 will actuate electric motor 40 for rotation of an extending drive shaft 41 in the direction dictated by the direction of rotation of the switch actuator, as will be further explained hereinafter.

Switch actuator 71 connects to a drum switch 75 in electrical connection to a power source (not shown) and leading to electric motor 40 in a conventional manner. The electrical connections and circuity employed are of conventional construction and are not further described or shown herein in the interest of brevity.

A linear rod 76 has one end thereof connected to each of switch actuators 70,71 by a suitable rotative universal connection such that manual rotation of either switch actuator 70,71 causes a like movement of the other switch actuator. Thus, the up-down action for passenger chair 45 may be actuated at either the top or bottom of the stairway. Also, linear rod 76 is disposed adjacent hand rail 82 (illustrated in FIG. 7) within easy reach of the occupant of passenger chair 45 at all times to thereby permit the passenger to move switch actuators 70,71 to stop or start the movement of conveyor belt 44 at any point along the inclined stairway.

Figure 7:
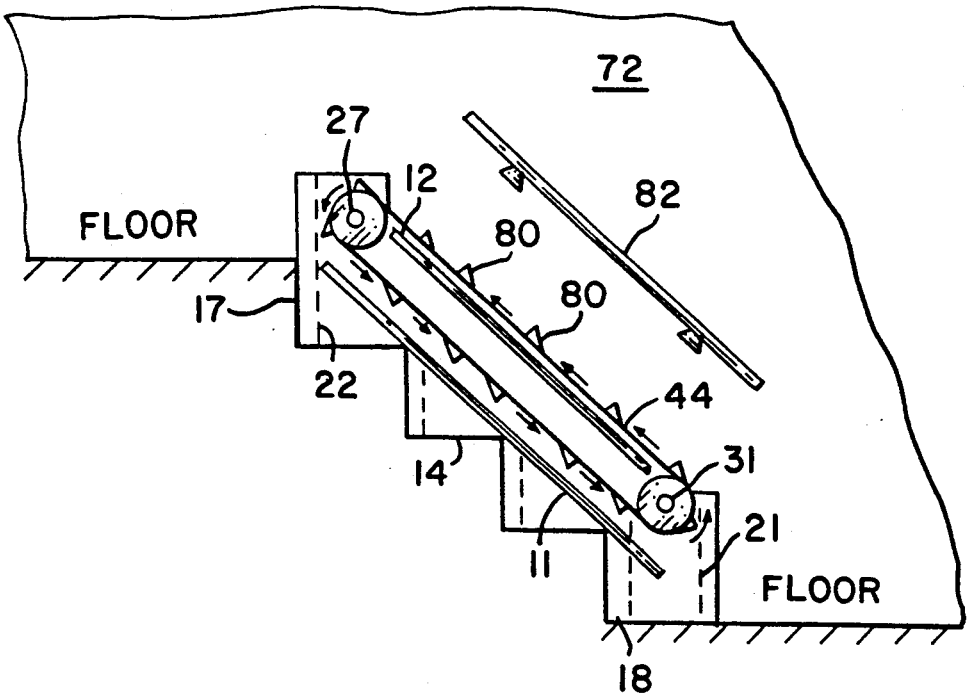
FIG. 7 is a view similar to FIG. 1 with parts omitted and illustrating an alternate embodiment of the portable passenger lift device of the present invention.
Figure 8:
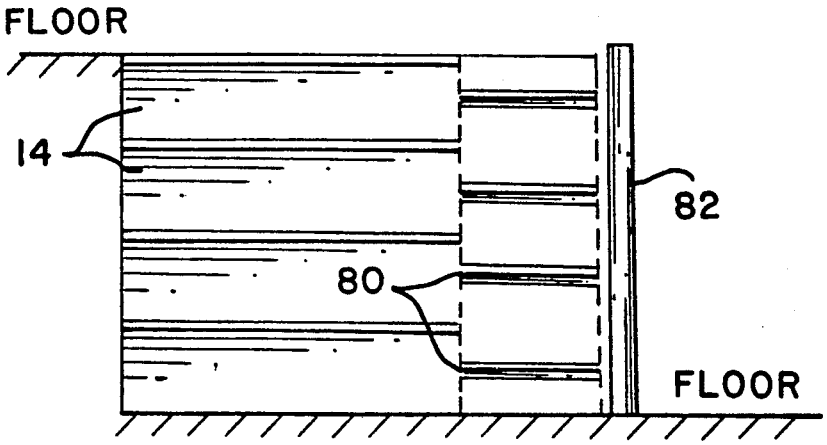
FIG. 8 is a top plan view of the embodiment shown in FIG. 7.

Referring now more particularly to FIGS. 7 and 8, an alternate embodiment of the passenger support mechanism for the portable stair lift of the present invention will now be described. In this embodiment, passenger chair 45 is replaced by a plurality of stair step segments 80 attached to suitable angle iron brackets, not designated, bolted at spaced intervals to conveyor belt 44. Additional spacing is provided between conveyor belt 44 and bottom elongated metal plate 11 to provide adequate spacing between plate 11 and conveyor belt 44. This additional spacing permits step segments 80 to pass unimpeded as conveyor belt 44 rotates about rollers on axles 27,31, as in the previously described embodiment. An identical drum switch and switch actuators are employed in this embodiment as that illustrated and described in reference to FIG. 1 and are not shown or described further here in the interest of brevity.

The movement of a passenger standing on step segments 80 up inclined stairs 14 would be when conveyor belt 44 is rotating in the direction of the arrows shown. For down movement, conveyor belt 44 would rotate in the reverse direction. A suitable hand rail 82 is secured to the wall of the stairway in a conventional manner, when so desired. Linear rod connector 76 (illustrated in FIG. 1) is disposed adjacent the stair hand rail 82.

Figure 9:
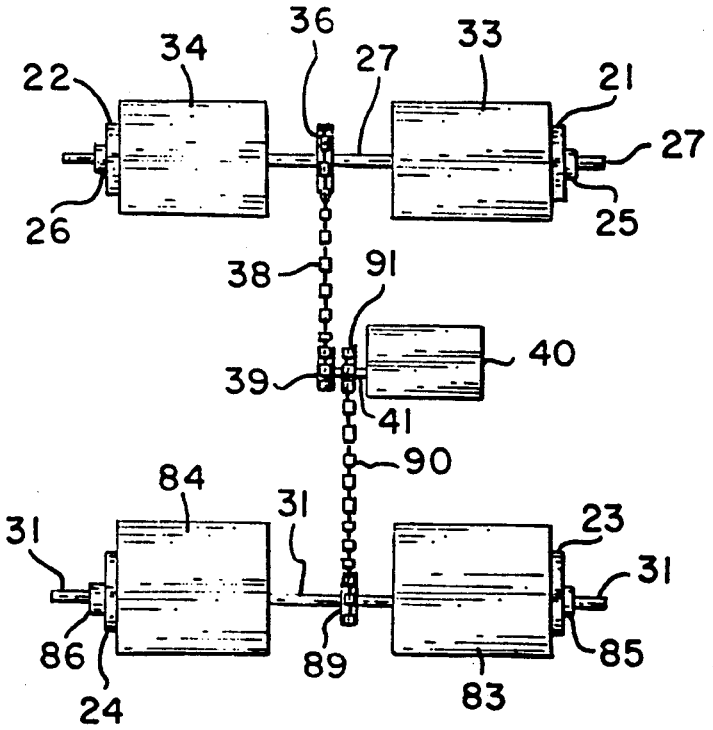
FIG. 9 is a part schematic view similar to FIG. 1*a* and illustrating a modified drive mechanism for the portable lift system shown in FIG. 1.

Referring now more particularly to FIG. 9, an alternate drive mechanism for conveyor belt 44 is shown. In this embodiment, axle 27 extends through bearings 25,26 disposed in aligned openings in brackets 21,22. A pair of spaced roller segments 33,34 are attached to and rotatable with axle 27, as in the previously described embodiment. Also, sprocket wheel 36, disposed between roller segments 33,34, is attached to and rotatable with axle 27 with chain drive 38 being connected about sprocket wheel 36 and drive wheel 39 driven by electric motor 40.

Axle 31 in this embodiment also supports a pair of spaced roller segments, as designated by reference numerals 83,84. Brackets 23,24 have aligned openings that house bearings 85,86 for rotatably receiving the ends of axle 31. An additional sprocket wheel 89 is secured to axle 31 and provided with a drive chain 90 therearound. Drive chain 90 is also disposed about a drive wheel 91 driven by electric motor 40 through the same drive shaft 41 that drives wheel 39. Drive wheels 39,91 are of the same diameter and thus, rotate at the same speed as driven by drive shaft 41. Also, sprocket wheels 36,89 are of equal diameter to insure equal speed rotation of axles 27,31. The use of the double drive embodiment illustrated in FIG. 9 is not normally needed for short stairways (up to six steps) but does prove practical for stair lifts employed on longer stairways.

The operation of the invention is now believed apparent from the above description. The stair lift assembly is considered portable in that it can be installed or removed by two workmen without altering an existing stairway. In the illustrated preferred embodiment the stair lift is installed on a four step stairway and the elongated metal members 11,12 constructed of one-half inch stainless steel plate cut to eight inches width. Motor 40, in the illustrated embodiment, is a one-quarter horsepower electric gear motor available from Dayton Electric Company, SA LR 3459, Model No. 9K128C, and powered by a standard household (110 v) current source (not shown). Motor 40 is geared to provide rotation of drive shaft 41 to cause movement of conveyor belt 44 and the attached passenger support (chair or simulated steps) at the desired controlled rate. For a specific drive shaft rotation speed, the rate of the passenger support movement is determined by, and may be controlled by, the size selection of the drive and sprocket wheels.

Once installed, as shown in FIG. 1, electric motor 40 is plugged into, or otherwise conventionally connected to, a suitable household current supply source (not shown). Stair lift 10 is actuated by rotation of manual switch crank 71 attached to rotary drum switch 75. Drum switch 75 in the illustrated embodiment is the commercially available reversible drum switch, Class 2601, Type A.G. 2, Series B, available from the SQUARE D Company. Manual rotation of switch crank 71 by the lift occupant moves the switch crank from the flat position shown in FIG. 1 toward the occupant to start motor 40 in the neutral position when the switch crank switch 71 is directed toward the seat occupant or ninety degrees relative to stairway wall 72. When rotated further to place switch crank 71 again to a flat position opposite to that shown in FIG. 1 causes motor 40 to drive roller segments 33,34 and rotate conveyor belt 44. Rotation of manual switch crank 71 effects simultaneous rotation of switch crank 70 through connected linear rod 76. Once chair support 45 reaches the top of stairway 14, rotary switch contact 62 engages rotary switch 66 to stop motor 40 and consequentially conveyor belt 44. When motor 40 is cut-off by either rotary contact switch 66 or 67, it remains off until either up/down switch crank 70 or 71 is again manually actuated.

The embodiment of FIGS. 7-8 operates in a similar manner except that no rotary cut-off switches are employed and conveyor belt 44 continues to rotate until either manual switch crank 70 or 71 is actuated. In this embodiment conveyor belt 44 may be continuously rotated for use by multiple passengers, in succession, if so desired whereas, the embodiment of FIG. 1 permits only limited movement and conveyor belt 44 must be returned to the starting point before it can be used for movement of a second passenger in the same direction as that of the first passenger.

The roller segments in the specific embodiments described herein were constructed of tubular metal and provided with an abrasive coating to facilitate rotation of conveyor belt 44. Any suitable metal, hard rubber, or other commercially available rollers normally employed in conveyor systems are considered applicable for use in the present invention. Conveyor belt 44 is a commercially available, heavy duty, conveyor belt that may be purchased in desired lengths and widths and connected by conventional alligator-type clips.

Although the invention has been described relative to specific embodiments thereof it is not so limited and there are numerous modifications and variations thereof that will be readily apparent to those skilled in the art in the light of the above teachings. For example, additional strengthening angle iron segments may be employed to prevent buckling of the elongated metal members. Also, a single or additional shims may also be employed, in lieu of the two shims illustrated, to support the plate segments for the passenger supports. The stainless steel employed for the elongated metal members may also be replaced by other adequate strength metal, composites, or the like without departing from the scope of the present invention.

Thus, although numerous novel features of the invention have been specifically shown and described in the detailed examples herein, these specific embodiments are to be considered as illustrative of the principles of the invention and are not to deemed as exhaustive. Also, various omissions, substitutions and changes in the forms and details of the stair lift embodiments described herein can be made by those skilled in the art without departing from the spirit and scope of the invention. It is therefore to be understood that, within the scope of the appended claims, that the invention may be practiced other than as specifically described herein.

What is claimed as new and desired to be secured by Letters Patent of the United States is:

I claim:

1. A portable stair lift system for transporting a passenger up or down an inclined stairway comprising:

a pair of spaced elongated metal plates of substantially the same length as the stairs over which a passenger is to be transported;

a support structure disposed at each end of the stairs;

a pair of spaced end bracket means secured to each said support structure;

said pair of spaced end bracket means being connected to and maintaining said pair of spaced elongated metal plates in parallel spaced relationship;

a rotatable axle extending through each of said pair of spaced end bracket means and disposed adjacent each end of said pair of spaced elongated metal plate members;

at least one roller member secured to and rotatable with each said rotatable axle;

bearing means disposed in each said end bracket means for rotatably supporting an end of each said axle;

an integral sprocket wheel secured to and rotatable with at least one of said axles;

an electric motor for said portable chair lift;

a drive shaft extending from and driven by said electric motor;

at least one chain drive pulley secured and driven by said drive shaft;

a drive chain connecting said at least one chain drive pulley to said sprocket wheel on said at least one axle;

a conveyor belt extending around and rotatably driven by at least one of said roller members;

a passenger support structure secured to and movable with said conveyor belt for transporting a passenger along the length of the inclined stairway; and switch means leading to an electric power source and to said electric motor for enabling a passenger transported by said passenger support structure to reversibly control the direction of movement of said conveyor belt and said passenger support structure.

2. The portable stair lift system of claim 1 wherein said support structure disposed at each end of the stairway comprises a block of wood at each end of the stairway; and each said pair of end bracket means comprises a pair of spaced L-shaped brackets each having one leg thereof vertically extending along an end of one said block of wood.

3. The portable stair lift system of claim 1 wherein said at least one said roller member on one of said rotatable axles includes a split drive roller;

said split drive roller being provided with a pair of spaced roller segments secured to and rotatable with at least one of said axles and wherein said integral sprocket wheel secured to at least one said axle is disposed between said pair of spaced roller segments.

4. The portable stair lift system of claim 1 wherein said at least one roller member secured to and rotatable with each said axle comprises a split drive roller on each said axle;

each said split drive roller being provided with a pair of spaced roller segments secured to and rotatable with one of said axles;

an integral sprocket wheel being secured to each said axle intermediate to said pair of spaced roller segments thereon;

said at least one chain drive pulley comprising a pair of chain drive pulleys disposed on said drive shaft; and a separate drive chain connecting each chain drive pulley to one of said sprocket wheels.

5. The portable stair lift of claim 4 wherein said switch means comprises a reversible drum switch;

a first switch actuator operatively secured to said reversible drum switch and disposed adjacent the bottom of the portable stair lift when installed on an inclined stairway;

a second switch actuator disposed adjacent the top of the portable stair lift;

each said first and said second switch actuator being crank-shaped and provided with a horizontal center section having a right angle segment extending in opposite directions from each end thereof;

a rod connector secured to each said switch actuator such that movement of either switch actuator effects an identical movement of the other switch actuator;

each said switch actuator being reversibly movable from a first position whereby said drum switch causes said motor to rotate said drive shaft thereon in a first direction to a second neutral position, wherein said drive shaft is not rotating, to a third position wherein said motor rotates said drive shaft in a second and reverse direction to said first direction.

6. The portable stair lift of claim 5 including:

means for attaching said first and said second switch actuators to a wall adjacent to the inclined stairway traversable by use of said stair lift;

a stairway handrail secured to the stairway wall and extending along the length of said stairway;

said rod connector secured to each said switch actuator being adjacent said handrail; whereby said rod connector is in position to be grasped and linearly moved by a passenger on said stair lift at any point along the stairway to effect movement of said switch actuators and said drum switch to thereby provide emergency stop/go control for said stair lift at any point of travel thereof.

7. The portable stair lift system of claim 1 wherein a first member of said pair of spaced elongated metal plates has a bottom surface resting on the edge of the individual steps of the inclined stairway and a top surface facing the bottom surface of the spaced second member of said pair of spaced elongated metal plates;

said second member of said pair of spaced elongated metal plates having a top surface facing said conveyor belt and a bottom surface facing the top surface of said first member of said pair of spaced elongated metal plates; and at least a pair of angle iron segments secured to said bottom surface of said second member of said pair of elongated metal plates to provide strengthening and buckle resistance to said second member.

8. The portable stair lift system of claim 7 wherein said passenger support structure secured to and movable with said conveyor belt comprises:

a plurality of spaced step segments secured to and movable with said conveyor belt;

said step segments being disposed along the entire length of said conveyor belt; and wherein adequate spacing is provided between said top surface of said first member of spaced elongated metal plates and said conveyor belt to permit unobstructed passage of said conveyor belt and said step segments secured thereto as said conveyor belt rotates about said roller members.

9. The portable stair lift system of claim 7 wherein said passenger support structure secured to and movable with said conveyor belt includes at least one metal plate section bolted to and movable with said conveyor belt;

a tubular member integrally secured to said at least one metal plate section; and a passenger chair having an elongated base slidably received by and freely rotatable within said tubular member.

10. The portable stair lift system of claim 9 including a passenger foot rest releasably secured to said passenger chair and rotatably secured to said tubular member.

11. The portable stair lift system of claim 9 wherein two metal plate sections are bolted to each other via at least two rows of bolts extending through said two metal plate sections and through a section of said conveyor belt sandwiched therebetween.

12. The portable stair lift system of claim 11 including at least a pair of spaced metal shims attached to the top surface of and extending the length of said second member of said pair of elongated metal plates;

each bolt in said at least two rows of bolts being provided with a bolt head that protrudes from a first one of said two metal plate sections;

said first one of said two metal plate sections being disposed in slidable contact with said pair of shims; and said bolt heads being disposed adjacent said shims and prevented from contacting said second member of said pair of elongated metal plates by said shims as said conveyor belt moves said passenger support structure along the length of the inclined stairway.

* * * * *